US006053709A

United States Patent [19]

Reavis

[11] Patent Number: 6,053,709

[45] Date of Patent: Apr. 25, 2000

[54] PUMP FOR MOVING VISCOUS FLUID MATERIALS

[76] Inventor: William N. Reavis, 10995 Gillette, Overland Park, Kans. 66210

[21] Appl. No.: 09/106,430

[22] Filed: Jun. 29, 1998

[51] Int. Cl.[7] ..... F04B 35/00

[52] U.S. Cl. ..... 417/401; 417/528

[58] Field of Search ..... 417/393, 399, 417/401, 403, 528, 534, 360, 347

[56] References Cited

U.S. PATENT DOCUMENTS

| | | | |
|---|---|---|---|
| 2,801 | 10/1842 | Babbit et al. | 417/533 |
| 3,010 | 3/1843 | Higbie | 417/533 |
| 336,459 | 2/1886 | Wheeler . | |
| 930,781 | 8/1909 | McCutchen | 417/401 |
| 2,255,305 | 9/1941 | Zehner | 417/528 |
| 2,834,295 | 5/1958 | Hjärpe | 417/533 |
| 3,015,280 | 1/1962 | King | 417/401 |
| 3,164,101 | 1/1965 | Van Nederynen . | |
| 3,374,746 | 3/1968 | Chenault | 417/528 X |
| 3,612,731 | 10/1971 | Tanemoto | 417/533 |
| 3,659,970 | 5/1972 | McElroy | 417/533 |
| 4,026,661 | 5/1977 | Roeder | 417/401 X |
| 4,334,834 | 6/1982 | Werner et al. | 417/360 |
| 4,473,340 | 9/1984 | Walsworth | 417/401 X |
| 4,744,735 | 5/1988 | Niemand | 417/533 |
| 5,009,580 | 4/1991 | Maru | 417/533 |
| 5,490,694 | 2/1996 | Shumway | 285/305 |
| 5,505,593 | 4/1996 | Hartley et al. | 417/393 |
| 5,984,642 | 11/1999 | Danielson | 417/397 X |

*Primary Examiner*—Charles G. Freay
*Assistant Examiner*—David J. Torrente
*Attorney, Agent, or Firm*—Kenneth W. Iles

[57] ABSTRACT

A pneumatically driven pump includes a piston threadably connected to each end of a common connecting hollow rod which is inserted over a pumped material receiving tube, with this assembly enclosed in a housing. The pistons reciprocate in response to compressed air sequentially directed through different air ports in the housing, alternatively drawing in pumped material and then pumping it out of the pump through the pumped material tube along the center of the pump. A check valve at each of the inflow and outflow ends of the pump prevents back flow of the pumped material.

20 Claims, 4 Drawing Sheets

PUMP FOR MOVING VISCOUS FLUID MATERIALS

BACKGROUND OF THE INVENTION

1. Field of the Invention

The present invention is related to an apparatus for pumping viscous liquids. More particularly, the present invention is directed to an apparatus for pumping a tire sealant from a supply source into a tire.

2. Description of Related Art Including Information Disclosed Under 37 C.F.R. Sections 1.97–1.99.

A significant industry has been developed to install a viscous tire sealant material into pneumatic vehicle tires. Tire sealant permanently and automatically seals leaks up to about 0.6 cm, thereby saving time and money. Tire sealant can either be pumped into a mounted tire through the valve stem or pumped directly into the tire through the space between the tire bead and the wheel bead seat when the tire is mounted on a wheel, but not yet inflated.

Currently, two types of pumps are used to move the tire sealant from a supply source, typically a 200 liter barrel or 25 liter bucket, into the tire. A small hand operated pump has an external diameter of about 3–4 cm and a length of about 25–35 cm. A single piston is manually pulled upwardly while the lower end of the pump or an attached hose is immersed in a supply of tire sealant, drawing sealant into the pump's piston cylinder. Pushing down on the pump handle opens a ball valve in the hollow piston connecting rod, and the sealant material is forced upwardly through the hollow piston connecting rod into a line to the tire. This hand pump is suitable for small numbers of small jobs. Because the tire sealant is quite viscous, considerable exertion is required to force the material through the pump and tubes and use of this pump can be fatiguing. Further, it is not suitable for use with large tires, which can require up to 40–50 liters of tire sealant each and which can take ten minutes of hard hand pumping to fill with this pump because it has a capacity of only about 250 cc. Finally, using this pump uses far more time for pumping the material because it has a relatively small capacity, so it is not useful in high volume use.

Another pump used for installing tire sealant is a single piston pneumatic pump having a short stroke and a small chamber, which can pump only about 125 cc per stroke. This pump, called a stub pump, exerts very high air pressure with its small piston and short stroke. The volume of pumped sealant is determined by counting and regulating the number of stroke cycles. In addition, it is relatively expensive.

Therefore, there is a need for a pump for moving viscous materials that operates with readily available source of compressed air that can be preset and deliver an accurately determined volume of pumped material in a consistent manner; that is convenient and easy to use; that can be used with any size of pumped material container; that is easy to maintain and service; that can be adapted for use in various shop or field environments; and that is relatively inexpensive to manufacture.

SUMMARY OF THE INVENTION

Accordingly, it is a primary object of the present invention to provide a pump for moving viscous fluid materials that operates on a readily accessible source of compressed air.

It is another object of the present invention to provide a pump for moving viscous fluid materials that provides for the delivery of an accurate present and adjustable volume of viscous pumped material.

It is another object of the present invention to provide a pump for moving viscous fluid materials that is convenient and easy to use.

It is another object of the present invention to provide a pump for moving viscous fluid materials that can be conveniently and easily used with large volume applications;

It is another object of the present invention to provide a pump for moving viscous fluid materials that can be used with any size of commercial container of material to be pumped.

It is another object of the present invention to provide a pump for moving viscous fluid materials that can be adapted for use in various shop or field environments.

It is another object of the present invention to provide a pump for moving viscous fluid materials that is easy to maintain and service.

It is another object of the present invention to provide a pump for moving viscous fluid materials that is relatively inexpensive to manufacture.

The pump for moving viscous fluid materials, or pump, includes two longitudinally aligned pistons with one piston attached to each end of a common tubular connecting rod. The tubular connecting rod reciprocates along a hollow material flow tube centrally disposed along the length of the cylindrical pump housing. The viscous material moves through the material flow tube during pumping. Each end of the material flow tube is threaded. A central bulkhead member, or center cap, forms the center end of each piston cylinder, with a cylinder barrel place adjacent to each end of the center cap. One cylinder barrel is a translucent air cylinder barrel, which receives compressed air to drive the pump on the intake stroke. The other cylinder barrel is a pumped material cylinder barrel, which receives and pumps the pumped material and which is driven by compressed air to expel the pumped material into a delivery feed line. The material flow tube holds the pump assembly together. The pump assembly is held together by fastening an entry assembly cap is fastened onto one end of the material flow tube by a nut, and an exit assembly cap is similarly fastened onto the other end of the material flow tube, holding the entry assembly cap, pumped material barrel, center cap, air cylinder barrel, and exit assembly cap, together as one unit. An external flap swing check valve and housing assembly is threadably fastened to the outer surface of each end cap.

Other objects and advantages of the present invention will become apparent from the following description taken in connection with the accompanying drawings, wherein is set forth by way of illustration and example, the preferred embodiment of the present invention and the best mode currently known to the inventor for carrying out his invention.

DETAILED DESCRIPTION OF THE PREFERRED EMBODIMENTS

Figure 1:
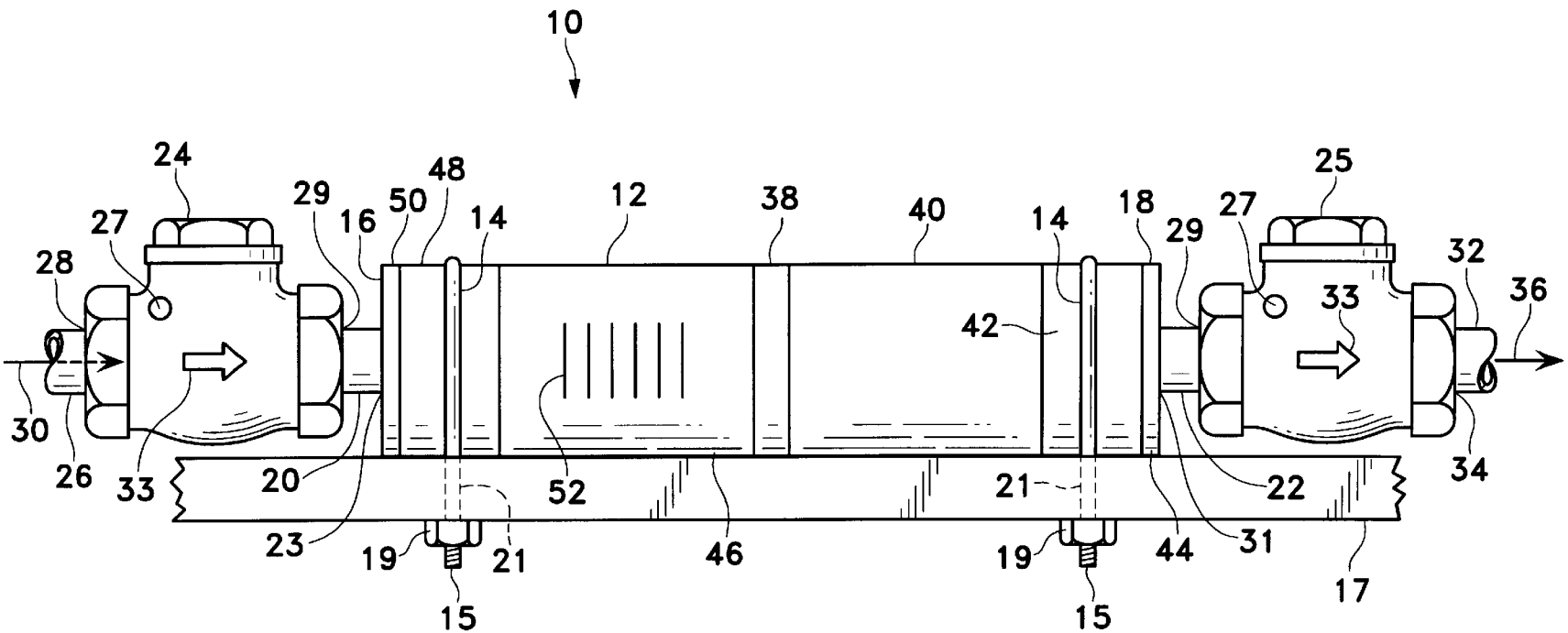
FIG. 1 is a side elevation of the pump for moving viscous fluid materials, including external swing-check valves and housing.

Referring to FIG. 1, the pump for moving viscous fluid materials or pump, 10, includes a cylindrical housing 12 with a circumferential groove 14 adjacent to each end of the cylindrical housing 12, including a left-hand or lower end (FIG. 2) 16 and a right-hand or upper end (FIG. 2) end 18. The circumferential grooves 14 are for attaching the pump 10 to a stand or base 17 by U-bolts 15, which penetrate the apertures 21 in the base 17 and are secured by the nuts 19. The base 17 may be a wall, board that, for example can be placed on top of a large barrel of material to be pumped, a specially designed stand or the like. A left-hand side nipple fitting 20 is threadably received into a threaded aperture 23 in the left-hand end 16 and right-hand side nipple fitting 22 is threadably received into a threaded aperture 31 in the right-hand end 18 of the cylindrical housing 12. A left-hand side swing check valve and housing assembly (check valve) 24 is threadably attached to the left-hand side nipple fitting 20 and another, (right-hand side check valve 25) is separately attached to the right-hand side nipple fitting 22. Each check valve 24, 25, 54 and 56, which are all the same, includes a pivot pin 27 adjacent to a check valve inlet port 29 and a required commercially available as a separate brass swing check valve. Alternatively, similar valves can be incorporated into the cylindrical housing 12, which results in a longer cylinder and more expensive housing, and more difficult maintenance, the principal drawbacks to internalizing the valves. A feed line 26 is attached to an entry port 28 of the left-hand check valve 24, allowing the inflow of pumped material in the direction of the arrow 30. The supply line 26 may be a flexible or rigid tubing or pipe having a distal end that is immersed in a supply of pumped material, such as a 25 liter bucket or 200 liter barrel. A feed line 32 is connected to an outlet port 34 of the right-hand check valve 25 for feeding pumped material in the direction of the arrow 36 to the ultimate use cite. In a preferred use of the pump 10, the pumped material is a tire sealant, which is either pumped into a tire through the tire air valve stem or through the opening presented between the bead of the tire and the bead seat of the wheel when the tire is mounted but not yet inflated.

Still referring to FIG. 1, the cylindrical housing 12 is composed of a number of separate elements held together by an internal pumped material tube, as discussed below. In the center of the cylindrical housing 12 is a center cap 38, which forms one end of each of two piston cylinders and provides venting (see FIG. 3). Moving along FIG. 1 to the right of the center cap 38 along the cylindrical housing 12, in order, are the following additional elements: an air cylinder barrel 40, an exit assembly cap 42, and an end cap 44. Moving along FIG. 1 to the left of the center cap 38 along the cylindrical housing 12 are the following additional elements, in order, a pumped material cylinder barrel 46, and entry assembly cap 48, and an entry end cap 50. The air cylinder barrel 40 and the pumped material cylinder barrel 46 are both preferably made from fiberglass and epoxy resin having an internal surface that is RMS 12–15 and will self-polish during use. Fiberglass and epoxy resin are the preferred material for the cylinder barrels 40, 46 because it cannot be dented, is self-polishing on the piston wear surfaces, and the fibers in the fiberglass simply separate, releasing air pressure safely rather than exploding if excessive air pressure is introduced into the pump 10. Other materials, such as aluminum or steel can also be used for the cylinder barrels 40, 46. All materials in the pump and valves have been selected for their compatibility to the ingredients of tire sealants, such as ethylene glycol, propolyene glycol, and fibrous materials, such as fiberglass, which are commonly used in tire sealants. The pumped material cylinder barrel 46 is preferably transparent or translucent to allow a user to see how much material is in side the cylinder during any one cycle. Graduated markings 52 along the pumped material cylinder barrel 46 allow for accurate measurement of the amount of material being pumped. All other elements of the cylindrical housing 12 are preferably made of a hard aluminum alloy. The pump of FIG. 1 can be mounted and operated horizontally, as illustrated.

Figure 2:
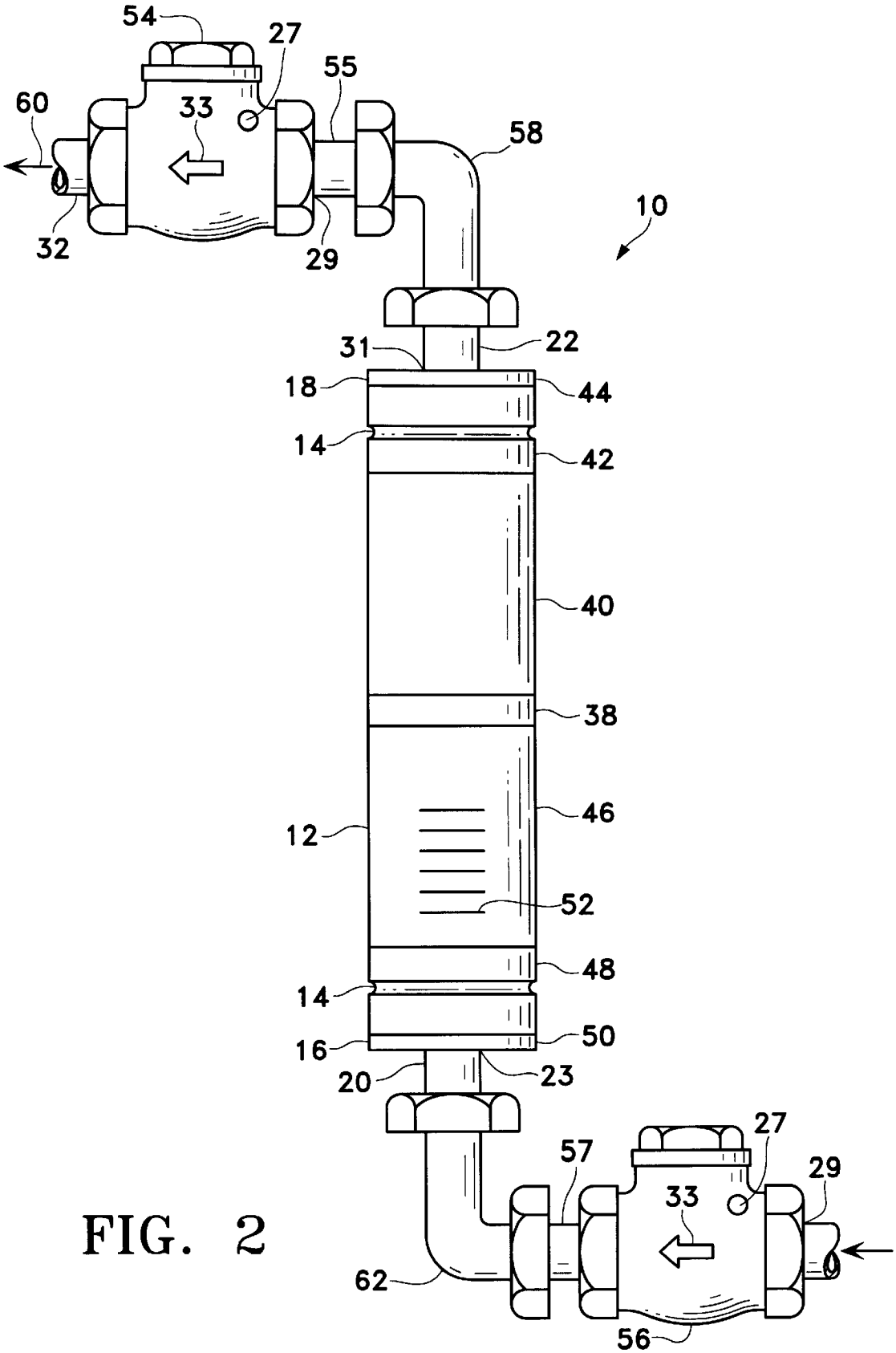
FIG. 2 is a side elevation of the pump of FIG. 1 showing the external swing check valves oriented differently.

Referring now to FIG. 2, an alternative embodiment of the pump 10 can be vertically mounted on a flat surface, such as a wall, or on a specially designed mounting bracket, in the orientation illustrated. The pump 10 is the same in both figures, including the upper and lower check valves 54, 56, respectively. The upper check valve 54 is connected to an upper nipple fitting 55, which is itself connected to the upper 90° elbow fitting 54. The upper 90° elbow is connected to the nipple 22, which is connected to the upper end 18 of the cylindrical housing 12, through the threaded aperture 31 to produce a horizontal outflow of the pumped material along the direction of the arrow 56. The lower check valve 56 is connected to a nipple fitting 57, which is in turn connected to the lower 90° elbow fitting 62. The lower 90° elbow fitting is connected to the nipple fitting 20, which is connected into the lower end cap 16 of the cylindrical housing 12 in the threaded aperture 23 to produce a basic inflow through the feed line 32 along the direction of the arrow 62. When the pump 10 is vertically oriented as shown in FIG. 2, the basic flow of material can be either from the top 18 to the bottom 16 or the bottom 16 to the top 18 of the pump 10. When used to pump a tire sealant, however, it is preferred that the basic flow direction be from the bottom 16 of the pump 10 to the top 18 of the pump 10 because these materials include glass fibers or other fibers that may settle out against the internal pistons and eventually fill the piston cylinders (See the discussion of FIG. 3, below). Again, it is crucial that the direction of flow be in line with the directional arrow 33 in all cases.

Figure 3:
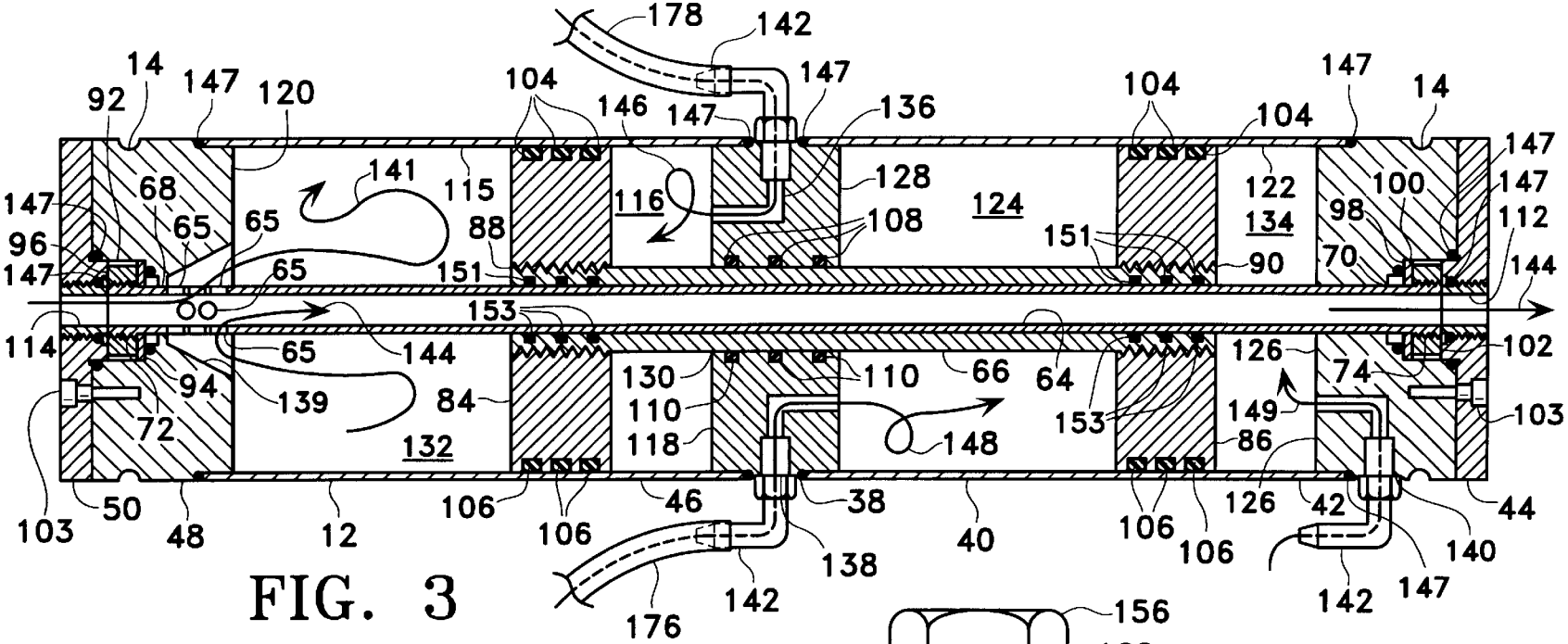
FIG. 3 is a cross sectional side elevation of the pump of FIG. 1 without the external valves.

Referring now to FIG. 3, a central longitudinal material flow tube 64, which is hollow and which preforms three functions. It holds the entire pump together as one unit; it guides the piston connecting rod 66, and it serves as a conduit through which the pumped material flows. Both the left-hand end 68 and right-hand end 70 of the material flow tube 64 are threaded with the threads 72, 74, respectively. The left-hand end, or pumped material receiving end, 68 of the material flow tube 64 includes material flow apertures 65, which allow the pumped material to flow into the material flow tube 64 and out of the feed line 32 during the pumping stroke, as explained below. The piston connecting rod 66 is tubular and mounts over the material flow tube 64. Both the left-hand end 76 and the right-hand end 78 of the piston connecting rod 66 are threaded with the threads allowing the pistons 84, 86 respectively to be threadably attached by the threaded piston apertures 88, 90, respectively.

During assembly, the piston connecting rod 66 is inserted over the material flow tube, and then a left-hand piston 84 is threadably attached to the left-hand end 76 of the piston connecting rod 66, the piston connecting rod 66 is inserted through the center cap 38, and a right-hand piston 86 is threadably attached to the right-hand end 78 of the connecting rod 66. Then the remaining principal body parts, the air cylinder barrel 40, the exit assembly cap 42, the sealant cylinder barrel 46, the entry assembly cap 48, of the cylindrical housing 12 are stacked onto the material flow tube 64 in any desired order that results in the configuration discussed above. The entry assembly cap 48 includes a nut well 92 for receiving a flat washer 94 and a jam nut 96 that are then tightened onto the left-hand end 68 of the material flow tube 64. Similarly, the exit assembly cap 42 includes a nut well 98, which receives a flat washer 100 and a jam nut 102, which are tightened on the right-hand end 70 of the material flow tube 66 to secure the entire assembly together for operation. The end caps 44, 50 are then secured to their respective exit assembly cap 42 and entry assembly cap 48 by three Allen head screws 103 in each end cap 44, 50, which seat flush with the outer surface of each end cap 44, 50. Each end cap includes a central material flow aperture 112, 114, through which the material flows to the check valves. Various O-ring seals 147 are also inserted between the various parts during assembly to provide air-tight seals at the designed pressures, as shown in FIG. 3. O-ring seals 151 are seated in the piston connecting rod grooves 153, with three seals 151 adjacent to each piston 84, 86.

Still referring to FIG. 3, both pistons 84, 86 are interchangeable and include three piston ring circumferential grooves 104, into which identical piston rings 106 are installed prior to assembly. The piston rings 106 bear against the interior side wall of the housing 12. Three sealing grooves 108 are formed in the center cap 38, which forms an end of each piston cylinder 40, 46. Each of the sealing grooves 108 receives an identical sealing ring 110. The pistons rings 106 and sealing rings 110 are all conventional O-rings made of a resilient rubber-like material. The pistons 84, 86 are made of a high-strength aluminum alloy.

Still referring to FIG. 3, the pumped material cylinder barrel 46 forms the cylindrical side wall of a sealant piston cylinder, consisting of the left-hand piston rear chamber 116 and the pumped material receiving chamber 132, with a bottom or rear cylinder wall 118 formed by the center cap 38 and a top cylinder wall 120 formed by a surface of the entry assembly cap 48. The air cylinder barrel 40 forms a cylindrical side wall 122 of the air piston cylinder, which consists of the air piston rear chamber 124 and the air piston front chamber 134, with a bottom wall 126 formed by a surface of the exit assembly cap 42 and an air cylinder top wall 128 formed by an inner surface of the center cap 38, which includes a central bore 130 through which the material flow tube 64 and the piston connecting rod 66 pass. This bore 130 is sealed by the sealing rings 110.

Still referring to FIG. 3, a pumped material cylinder air injection port 136 provides access from the outside to the chamber 116, which lies between the left-hand piston 84 and the center cap 38. An air cylinder air injection port 138 provides access from the outside to the area of the chamber 134 that lies between the right-hand piston 86 and the center cap 38, which is used to provide the motive power for the pump 10 in a preferred use. A breather vent port 140 in the exit assembly cap 42 prevents the buildup of pressure in the chamber 134. Each air port 136, 138, 140 is fitted with a nipple fitting 142 to allow attachment of compressed air hoses, air filters, and so forth.

In operation, the pumped material flows from left-to-right as depicted in FIG. 3, through the material flow tube 64 in the direction of the flow arrows 144.

Figure 4:
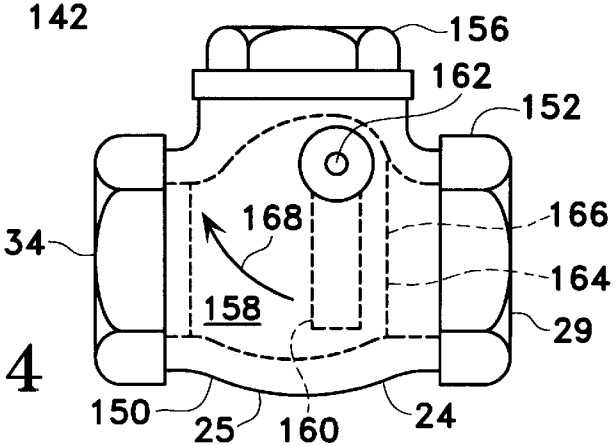
FIG. 4 is a side elevation partially in cross section of the swing-check valve members of the pump of FIG. 1.

Referring now to FIG. 4, the swing check valve and housing assembly 24, 26 (which are the same) is used for every check valve in the pump 10. It includes a hollow check valve housing 150 that includes an inlet port 29, which includes an inlet fitting 152 and an outlet port 34, which includes an outlet fitting 154. A threaded plug 156 allows access to the valve cavity 158 for assembly and maintenance. Again, the mark 27 on the housing 150 is adjacent to and denotes the inlet port 29, but is not visible in FIG. 4. Inside the check valve housing 150, a swing check valve, or flap valve, 160 is pivotally attached by a pin 162 mounted in apertures in the side walls of the housing 150. A valve seat 164 is formed in the end wall 166 of the check valve housing 150. The flap valve 160 swings to an open horizontal position along the direction of the arrow 168 in response to fluid pressure introduced from the inlet port 29 and swings downwardly along the same arc to close. The absence of positive pressure from the direction of the inlet port 29 allows the flap valve 160 to fall closed. If back flow of material begins, the flap valve 160 closes firmly against the valve seat 164. This prevents pumped material from being drawn back into the pump during the non-pumping portion of the cycle. This is also the reason that the check valves 54 and 56 are still mounted horizontally even with the cylindrical housing 12 of the pump 10 is mounted vertically, as shown in FIG. 2. Any type of single direction check valve, such as a ball valve, diaphragm valve, butterfly valves can also provide adequate operation. The principal purpose of the check valves 24, 25, 54, 56 is to prevent back flow of pumped material.

Figure 5:
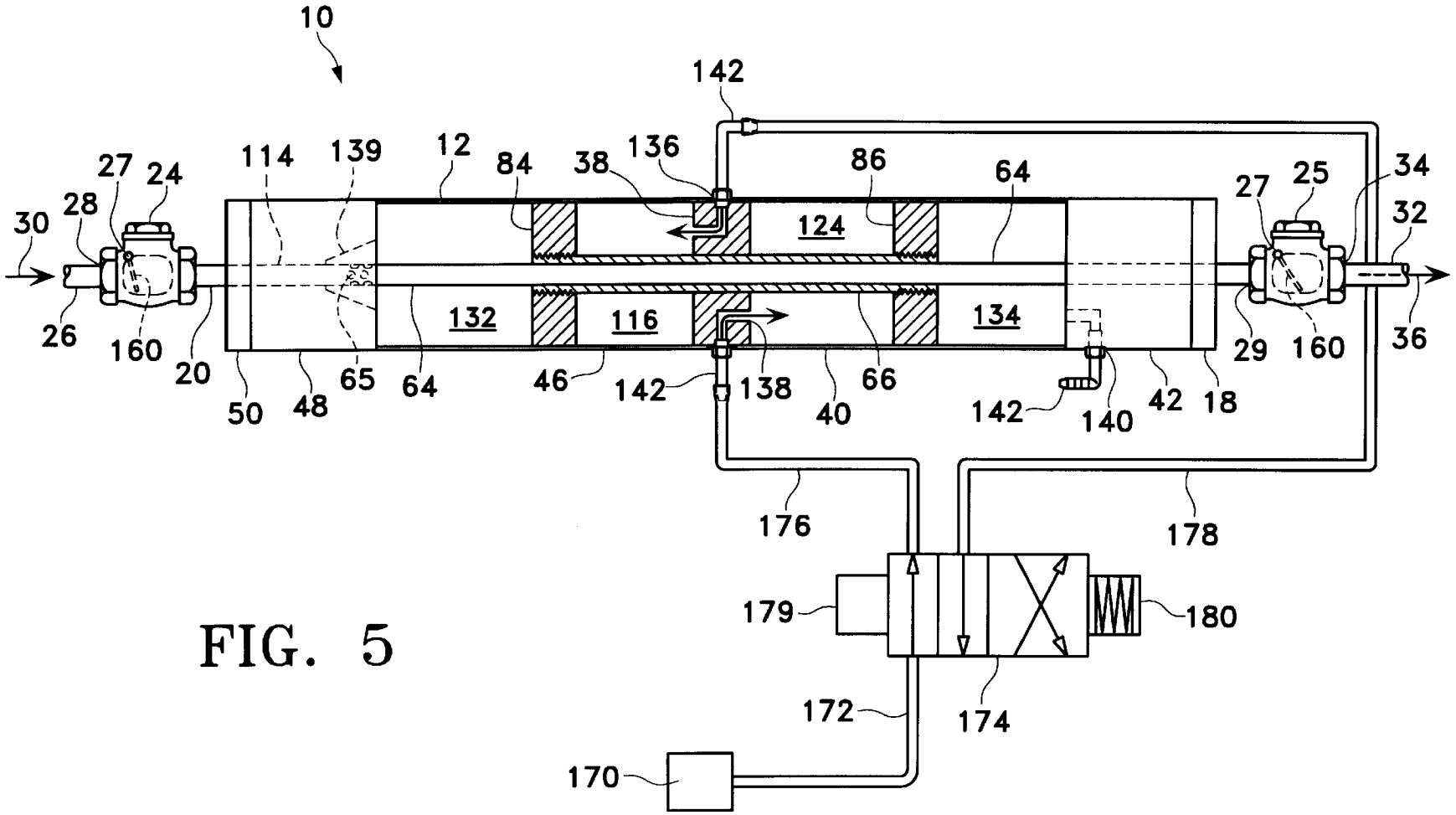
FIG. 5 is a side elevation schematic diagram of the pump of FIG. 1.

In operation, referring to FIGS. 3, 5, compressed air is use to cause the pistons 84, 86 to reciprocate simultaneously. Compressed air is sequentially injected into any of the three air ports 136, 138, and 140 to produce the required reciprocal movement. Injecting pressurized air into the air cylinder inlet port 138 causes the pistons 84, 86 to move toward the right in FIG. 3, opening the flap valve 160 in the check valve housing 24, drawing pumped material into the chamber 132, which is to the left of the piston 84, with air ports 136, 140 vented to the atmosphere. Any air ports 136, 138, or 140 that are not utilized for receiving or venting compressed air from the air compressor 170 may be fitted with a brass muffler or the like. Pumped material flows into the chamber 132 through the left-hand material flow aperture, or material inflow aperture, 114, the frustro-conical pumped material well 139 along the direction of the arrows 141 into the chamber 132. The frustro-conical material well 139 ensures that pumped material continues to flow into the material flow tube 64 when the piston 84 moves left (FIG. 3) and contacts the top cylinder wall 120. Injecting compressed air into the vent port 140 with the other two ports vented to the air, causes the pistons 84, 86 to move toward the left of FIG. 3, closing the valve 24, pumping the pumped material into the material flow tube 64 through the apertures 65 in the material flow tube 64 and ultimately expelling pumped material through the right-hand material flow aperture, or material outflow aperture, 112 and into the check valve 25, which opens in response to the pressure of the pumped material. Similarly, injecting compressed air into the sealant cylinder air port 136 while the other two ports are open to the air will also drive the pistons 84, 86 toward the left in FIG. 3, expelling pumped material through the material flow tube 64. Pressurizing both the ports 136 and 140 increases the force applied to the pistons 84, 86 and hence increases the outward flow pressure of the pumped material. In the preferred use, pressuring the chamber 124 through the air cylinder port 138 induces the piston 84 to draw pumped material into the chamber 132 and then pressurizing the chamber 116 through the sealant cylinder air port 138 expels the pumped material, while the vent port 140 remains open to the atmosphere to prevent pressurization of the chamber 134 behind the piston 86. Thus, in the preferred use, the chambers of the air cylinder barrel 40 receive only air and are used only to drive the pistons 84, 86 toward the right in FIG. 3, while the sealant cylinder barrel 46, to the left of the piston 84, receives the pumped material.

Referring to FIG. 5, there is shown one option for actuating the pump 10 using compressed air. To cycle the pump 10 as described above, it is necessary to have a means for directing compressed air to different air ports, namely 136 and 138, or 138 and 140, or all three, sequentially. Compressed air from an air compressor 170 is introduced through the hose 172 and into an air control valve 174, which directs compressed air through the hose 176 to the chamber 124 through the inlet port 138 to drive the pistons 84, 86 to the right in FIGS. 3, 5, thereby drawing pumped material into the chamber 132, while simultaneously venting the chambers 116 and 134 through the air ports 136 and 140 respectively to the atmosphere. When the chamber 132 has received the desired quantity of pumped material as indicated by the graduated marks 52, an operator pushes the button 179, reversing the action of the air flow control valve 174, causing the port 136 to receive pressurized air through the tubing 178 and simultaneously venting the chamber 124 through the port 138. This causes the pistons 84, 86 to move toward the left, expelling the pumped material through the feed line 32, as described above. When the button 176 is released, a return spring, or other reset activation device, 180 in the air flow control valve 174 causes the air flow to return to the first cycle, that is, pressurizing the chamber 124 and reloading the pump chamber 132 with tire sealant or other pumped material. The control button 179 can be replaced by a lever, foot pedal, electrical or pneumatic solenoid, or can be hand operated. The return spring 180 can be replaced by an electrical or pneumatic solenoid or can be activated by compressed air.

In a preferred embodiment, the pump 10 can operate on air pressure of 30 psi ($2.07\times10^6$ dynes/cm$^2$). Long lines to the supply of pumped material or to the ultimate site of use, however, require more air pressure. Required air pressure also depends on the viscosity of the pumped material and the quantity and nature of fibrous materials and fibers or particles in it. The pump has a capacity of about 8–10 liters/minute when used under these conditions. The pump 10 may be used to pump any medium viscous fluid or less than medium viscous fluid, slurry, solution, or the like.

While the present invention has been described in accordance with the preferred embodiments thereof, the description is for illustration only and should not be construed as limiting the scope of the invention. Various changes and modifications may be made by those skilled in the art without departing from the spirit and scope of the invention as defined by the following claims. For example, in an alternative embodiment, electrically actuated switches are used to control the flow of air and the timing of the switching or an electronic sensor on the exterior of the chamber 132 may be used to detect a desired amount of pumped material in the chamber, causing the pump 10 to expel that volume prior to recycling or to detect the amount of pumped material added into the pump chamber 132. In another alternative embodiment, the entire housing assembly 12 can be made of other materials, such as plastic, and may be injection molded in one piece. Two or more pumps may be ganged together to increase capacity.

I claim:

1. A pump comprising:

a. a material flow tube;

b. two pistons connected by a hollow connecting rod with said hollow connecting rod disposed concentric with and surrounding said material flow tube; and c. a pump housing enclosing said material flow tube, said hollow connecting rod and said two pistons.

2. A pump in accordance with claim 1 further comprising means for driving said pistons.

3. A pump in accordance with claim 2 wherein said piston driving means further comprises means for admitting and venting compressed air.

4. A pump in accordance with claim 3 wherein said compressed air admitting and venting means further comprises a separate air port for admitting and venting compressed air from each of a left-hand piston rear chamber, an air piston rear chamber, and a air piston front chamber.

5. A pump in accordance with claim 2 wherein said piston driving means further comprises a source of compressed air connected to a plurality of air ports in said pump housing.

6. A pump in accordance with claim 5 wherein said source of compressed air further comprises an air compressor and means for controlling sequentially switching the flow of compressed air between said air ports for driving said pistons in reciprocal motion along said material flow tube.

7. A pump in accordance with claim 1 further comprising means for conveying pumped material into said material flow tube.

8. A pump in accordance with claim 7 wherein said pumped material conveying means further comprises an entry assembly cap having a frusto-conical pumped material well penetrated by a material receiving end of said material flow tube and a plurality of apertures in said material flow tube adjacent to said frusto-conical pumped material well.

9. A pump in accordance with claim 1 wherein said housing further comprises a plurality of circumferential mounting grooves for use in attaching said pump to a flat surface.

10. A pump in accordance with claim 1 further comprising a material inflow aperture and a material outflow aperture in said housing and means for preventing back flow through either said material inflow aperture or said material outflow aperture.

11. A pump in accordance with claim 10 wherein said back flow preventing means further comprises a check valve on each of said material inflow aperture and said material outflow aperture.

12. A pump comprising:

a. a material flow tube having a pumped material receiving end comprising a plurality of pumped material receiving apertures;

b. two pistons connected by a hollow connecting rod with said hollow connecting rod disposed concentric with and surrounding said material flow tube; and c. a pump housing enclosing said material flow tube, said hollow connecting rod and said two pistons.

13. A pump in accordance with claim 12 wherein each said piston is threadably connected to said connecting rod.

14. A pump in accordance with claim 12 further comprising means for driving said pistons.

15. A pump in accordance with claim 14 wherein said piston driving means further comprises means for admitting and venting compressed air.

16. A pump in accordance with claim 15 wherein a source of said compressed air further comprises an air compressor and means for regulating and switching the flow of air through a plurality of air ports in said housing.

17. A pump comprising:

a. a material flow tube having a pumped material receiving end comprising a plurality of pumped material receiving apertures;

b. two pistons connected by a hollow connecting rod with said hollow connecting rod disposed concentric with and surrounding said material flow tube;

c. a pump housing enclosing said material flow tube, said hollow connecting rod and said two pistons, said pump housing further comprising a pumped material frustoconical pumped material well seated adjacent to said pumped material receiving end of said material flow tube; and d. means for reciprocally driving said pistons along said material flow tube.

18. A pump in accordance with claim 17 further comprising a material inflow aperture and a material outflow aperture in said housing and means for preventing back flow through either said material inflow aperture or said material outflow aperture.

19. A pump in accordance with claim 18 wherein said back flow preventing means further comprises a check valve on each of said material inflow aperture and said material outflow aperture.

20. A pump in accordance with claim 17 wherein said piston driving means further comprises an air compressor connected to an air flow control valve operatively connected to a plurality of air ports in said housing.

* * * * *